United States Patent [19]

Willitts

[11] 4,167,102

[45] Sep. 11, 1979

[54] REFRIGERATION SYSTEM UTILIZING SATURATED GASEOUS REFRIGERANT FOR DEFROST PURPOSES

[75] Inventor: Benjamin R. Willitts, Lawrenceville, N.J.

[73] Assignee: Emhart Industries, Inc., Farmington, Conn.

[21] Appl. No.: 868,089

[22] Filed: Jan. 9, 1978

Related U.S. Application Data

[63] Continuation-in-part of Ser. No. 644,263, Dec. 24, 1975, abandoned.

[51] Int. Cl.[2] ..... F25D 21/00

[52] U.S. Cl. ..... 62/152; 62/81; 62/509

[58] Field of Search ..... 62/509, 196 R, 152, 62/81, 199, 174

[56] References Cited

U.S. PATENT DOCUMENTS

| | | | |
|---|---|---|---|
| 3,343,375 | 9/1967 | Quick | 62/81 |
| 3,427,819 | 2/1969 | Seghetti | 62/278 X |
| 3,905,202 | 9/1975 | Taft et al. | 62/510 X |

OTHER PUBLICATIONS

Drawing No. A-14446-1, Kramer Trento Co.

Sketch 1/29/76, Hussman "Cool Gas" Installation at A&P Store, Ringwood, New Jersey.

*Primary Examiner*—William E. Wayner

*Attorney, Agent, or Firm*—Albert Sperry; Frederick A. Zoda; John J. Kane

[57] ABSTRACT

A system for refrigerating food products utilizes a saturated gaseous refrigerant, commonly called "cool gas" for defrosting an evaporator or set of evaporators. When defrost is to occur, the saturated gaseous refrigerant flows from a receiver through the evaporator or set thereof being defrosted. A differential pressure control switch operates to prevent flow of refrigerant to the receiver from the liquid supply line through which said refrigerant normally flows from the condenser to the evaporators. The flow from the liquid line to the receiver is prevented whenever the pressure in the liquid line exceeds the pressure in the receiver by a predetermined value. Accordingly, if liquid in the receiver is fully evaporated in providing saturated gaseous refrigerant for defrost purposes, and the pressure in the receiver is less than in the liquid line and causes the flow of liquid from the liquid line to the receiver to be closed off by operation of the differential pressure switch, the defrosting operation switches automatically from cool to hot gas as a response to the depletion of the cool gas supply.

9 Claims, 4 Drawing Figures

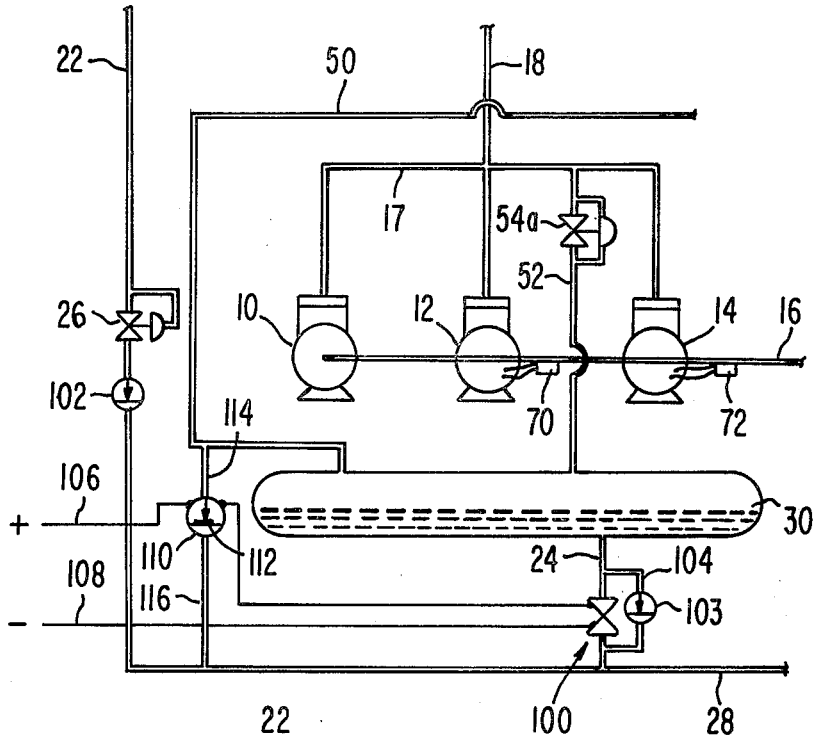
Fig. 2
Fig. 3
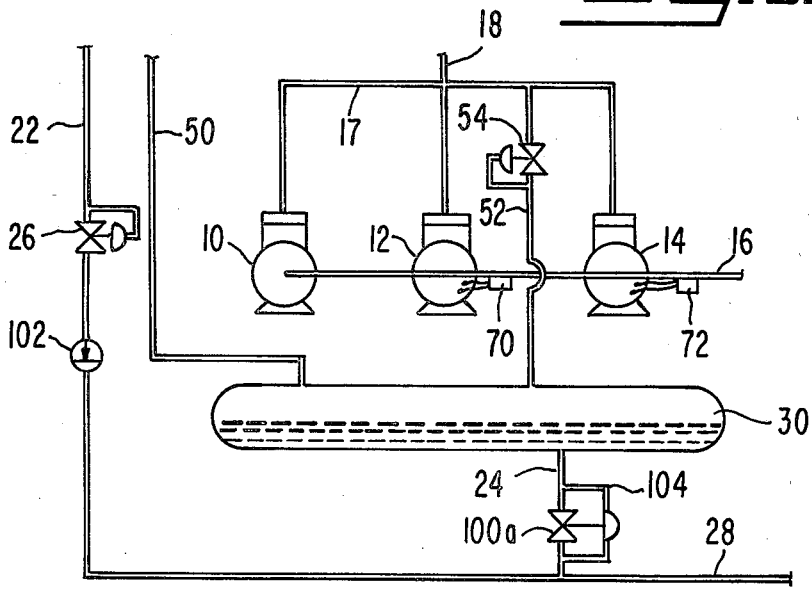

REFRIGERATION SYSTEM UTILIZING SATURATED GASEOUS REFRIGERANT FOR DEFROST PURPOSES

CROSS REFERENCE TO RELATED APPLICATIONS

The present application is a continuation-in-part of co-pending application Ser. No. 644,263 filed Dec. 24, 1975, now abandoned.

BACKGROUND OF THE INVENTION

1. Field of the Invention

The invention relates to refrigeration systems, particularly those of the type used in refrigerated display cases installed in food supermarkets. In a more particular sense the invention may be classified as a defrosting system of the type in which the fluid refrigerant normally used for refrigeration purposes is utilized, in a gaseous state, for defrost purposes.

In yet a more particular sense, the invention can be appropriately classified with those in which the defrost by the gaseous refrigerant utilizes, as a primary source of the defrost fluid, saturated gaseous refrigerant ("cool gas") flowing from a receiver through the evaporators being defrosted, reversely to the direction in which the fluid refrigerant normally flows during a refrigerating cycle.

2. Description of the Prior Art

The prior art is known to include refrigeration systems, utilizing the same basic relative arrangement as the present invention, in respect to the location and operating characteristics, within the system, of condensers, compressors, receivers, and evaporators. Typical of systems of this type is that disclosed in U.S. Pat. No. 3,905,202 issued Sept. 16, 1975. By way of example, a defrost arrangement is incorporated in the disclosed, patented system that utilizes hot gas flowing from the discharge line of the compressor or series of compressors, for defrosting the evaporators conventionally incorporated in the refrigeration system.

It is also known to provide, in a refrigerating system of the general category described previously herein, an arrangement in which saturated gaseous refrigerant ("cool gas") flows from the top of a liquid receiver, to the evaporators for defrost purposes. Such an arrangement is found in U.S. Pat. No. 3,427,819 issued Feb. 18, 1969.

The use of a hot gas defrosting system is widespread. Such systems are highly efficient. It is thought by some of the industry, however, that hot gas defrost systems may possess some disadvantages. For example, it has been contended that hot gas defrost systems will at times cause breakage and leaks in refrigerant lines due to excessively rapid, thermal expansion of tubing embodied in the system. And, it has also been contended that the evaporator coils are subjected, in hot gas defrost systems, to excessive defrosting temperatures, and have as a result produced visual fog or steam.

Accordingly, as an alternate to hot gas defrost, for use by those who have some objections to a hot gas defrost system, it has been heretofore proposed, as for example in the above-mentioned U.S. Pat. No. 3,427,819, to use, instead of hot gas, desuperheated or "saturated gas". This is known also in the industry as "cool gas", a term which will be used for purposes of convenience hereinafter, and which will be understood as meaning desuperheated or saturated gaseous refrigerant occurring in a refrigeration system of the type here under consideration.

SUMMARY OF THE INVENTION

In accordance with the present invention, a refrigeration system of the type disclosed in the above-mentioned patents, embodying a compressor or compressor series, a condenser, a receiver, and one or more evaporators or sets thereof, has tubing components arranged to permit flow of cool gas directly from the receiver to an evaporator that is to be defrosted, reversely to the normal flow of liquid refrigerant through said evaporator. Further summarized, the invention incorporates a pressure-responsive control valve in a connection conventionally provided between the system's liquid refrigerant supply line and the receiver. This valve is basic to a number of different embodiments of the invention. In each embodiment, it acts to temporarily prevent flow from the liquid line to the receiver, so that the liquid within the receiver may be fully evaporated in providing cool gas for defrost purposes. In these circumstances, hot gas flows from the compressor discharge line and through the receiver, which in these circumstances becomes primarily a conduit for the hot gas. The hot gas flows out of the receiver into the line connecting the receiver to the evaporators for defrost purposes.

Advantages from the automatic switching from cool to hot gas defrost operation are found in the elimination of the possibility of liquid refrigerant being "stolen" from the liquid supply line that extends to the evaporators, a condition known to cause flash gas and starving of the evaporators.

FIG. 2 is a fragmentary, diagrammatic illustration of the same system, showing a modified form;

FIG. 3 is a fragmentary, diagrammatic illustration of the system showing a third form of the invention.

DETAILED DESCRIPTION OF THE PREFERRED EMBODIMENT

Figure 1:
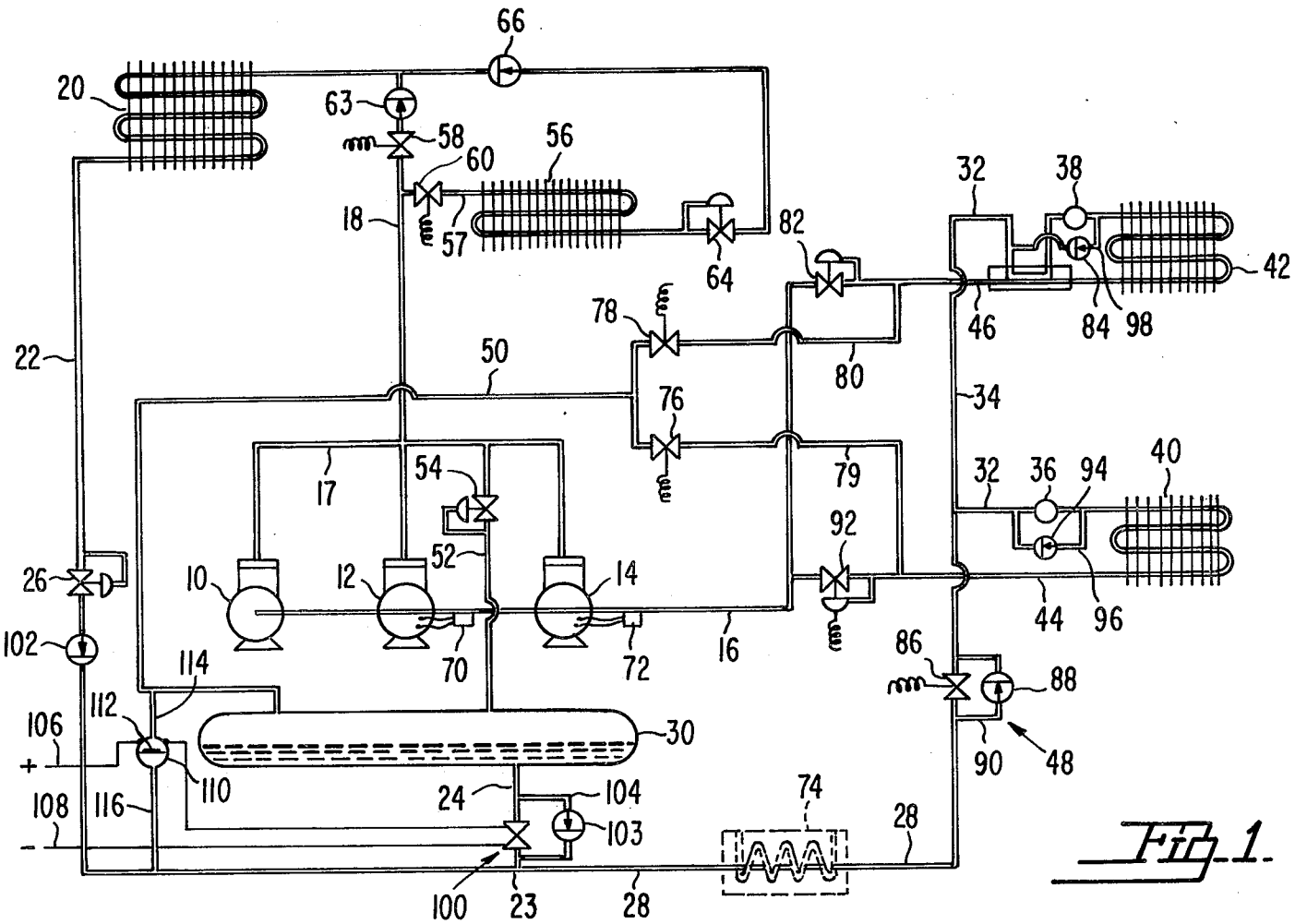
FIG. 1 is a diagrammatic illustration of a typical refrigeration system embodying one form of the invention.

Basic to all forms of the invention is a compressor means comprising compressors 10, 12, 14. The compressors are provided with a suction or low pressure side operating at a predetermined suction pressure. A suction header or intake line 16 is connected to the suction of the compressors. Vaporous refrigerant from the evaporators is returned to the compressors through the suction header. The compressors have a high side, to which is connected a discharge manifold 17, through which hot gaseous refrigerant is discharged, to flow through a discharge conduit or line 18 to condenser 20. The hot compressed gaseous refrigerant (hereinafter "hot gas") is reduced by condenser 20 to its condensing temperature and pressure, flowing from the condenser through condenser output line 22 to a joint or connecting fitting 23 that connects receiver liquid line 24 in communication with line 22.

Intermediate its ends, the condenser discharge conduit 22 is provided with a modulating pressure responsive valve 26, which is responsive to the pressure in the condenser and in the conduit 22 at the discharge side of the condenser, to modulate flow to evaporator liquid supply line 28 extending from joint 23 and disposed in constant communication with the conduit 22, thus in effect constituting an extension of the condenser discharge conduit.

Flow to line 28 is thus modulated in such fashion as to control the pressure within the condenser to provide partial or full flooding thereof.

A surge-type receiver 30 is connected at its bottom in communication with line 24 whereby to maintain a liquid refrigerant source for normal operation of the system.

Branch liquid lines or conduits 32 extend from a liquid header 34 constituting an extension of line 28, for supplying pressurized liquid refrigerant to expansion valves 36, 38 that control the supply of refrigerant to evaporators 40, 42. Refrigerant leaves the evaporators, during the refrigerating cycles thereof, through evaporator output branch lines 44, 46 respectively, extending into communication with return or suction line 16.

A pressure control means generally designated 48, positioned in header 34, maintains the pressure of refrigerant in the input branch lines 32, 34 at a value less than the refrigerant in the liquid line 28. This pressure differential assures against reverse flow during defrost. During defrost, gaseous refrigerant is directed to the evaporator or evaporators undergoing defrost through a main defrost line or header 50 extending from the top of receiver 30.

Connected between discharge manifold 17 and the top of receiver 30 is a receiver pressure control line 52, in which is installed a pressure reducing valve 54 arranged and functioning similarly to a corresponding line and valve disclosed in U.S. Pat. No. 3,905,202.

Also incorporated in the system is a heat reclaim means located and functioning similarly to a corresponding means disclosed in U.S. Pat. No. 3,905,202. It includes a heat reclaim coil 56 connected to discharge line 18 through a bypass line 57 in which is mounted a thermostatically controlled solenoid valve 60. A condenser inlet pressure regulating valve 64 is connected in line 62 extending from reclaim coil 56 to condenser 20 through a check valve 66, and serves to maintain the desired head pressure in the compressor when the heat reclaim coil 56 is in use. A solenoid valve 58 and check valve 63 are located in line 18 between the bypass line 57 and the condenser 20. Valve 58 closes when valve 60 is opened, so as to assure flow of hot gas in series through heat reclaim coils 56 and condenser 20 when the heat reclaim coil is in use.

The disclosure of U.S. Pat. No. 3,905,202 is further incorporated in the present application by reference, in respect to means for terminating operation of one or more of the compressors, responsive to reduction in the compressor suction pressures, said means being illustrated at 70, 72.

Also desirable in the system is a sub-cooler 74, mounted as illustrated in association with line 28 to assure the supply of refrigerant to the evaporators when, for example, abnormally high ambient temperature conditions are encountered.

When a particular evaporator, as for example evaporator 40 is undergoing defrost, the gaseous refrigerant used for defrost purposes will flow through the evaporator in a reverse direction as compared to the flow therethrough during a refrigerating cycle. If it may be assumed that evaporator 40 is in a defrost cycle while evaporator 42 is in a refrigerating cycle, it is important that the pressure of the gaseous refrigerant used for defrosting evaporator 40 and flowing in a reverse direction therethrough as compared to flow during a refrigerating cycle thereof, be greater than the pressure of refrigerant directed through evaporator 42, which in the example described is in a refrigerating cycle.

If a pressure differential did not exist under these circumstances, the desired reverse flow of the defrosting fluid through evaporator 40 would be prevented due to the pressure existing on the input side of evaporator 42. To achieve this desired pressure differential, the pressure control means 48 hereinbefore referred to, is placed at the inlet of the refrigerant supply header 34. By creating the pressure differential, reverse flow in a given evaporator or set thereof, required for defrost, is assured.

Means 48 includes solenoid actuated value 86 in header 34, mounted in parallel with check valve 88 located in bypass line 90. Valve 86 is normally open to allow full flow into the header 34 from line 28. Valve 86 is responsive to any evaporator or set of evaporators that are to undergo defrost, and in these circumstances closes to force refrigerant passing through the line 28 to flow through the bypass line 90. Valve 88 is set for any desired value such that the pressure of the refrigerant on the upstream side of the valve 88 will be greater, by a predetermined value, than the pressure on the downstream side of the check valve. By presetting of the pressure differential, full reverse flow through any evaporator or set thereof undergoing defrost is assured.

Alternatively, means 48 could be a pressure modulating valve, allowing variable and close control of the pressure differential. This is thought sufficiently obvious as not to require special illustration, it being mainly important to provide means at the location illustrated, that will assure an adjusted, regulated pressure upstream from the evaporators, in the liquid supply line through which refrigerant is supplied to the evaporators for refrigerating purposes.

Also incorporated in the illustrated system are solenoid valves 76, 78 controlling flow of the defrosting fluid from defrost header 50 to defrost branch lines 79, 80 that extend into communication with lines 44, 46. Solenoid valves 76, 78 are normally closed, but open to deliver the gaseous defrost fluid to their associated evaporators 40, 42. Normally open valves 92, 82, through which refrigerant returns to the compressors through suction line 16 during refrigerating cycles of the compressors, close simultaneously with opening of their respective, associated valves 76, 78, that is to say, if for example valve 76 opens, its associated valve 92 closes to terminate a refrigerating cycle in evaporator 40 and initiate a defrost cycle thereof.

During defrost, the gaseous defrost fluid directed through the evaporators undergoing defrost is cooled and is at least partially condensed to a liquid. The liquid condensate flows out of the evaporator through by-pass lines 96, 98 and check valves 94, 84 past the valves 36, 38. Each of these is open during the refrigerating cycle of its associated evaporator. During the defrost cycle valves 36, 38 close to an extent that would retard the flow of condensate out of the coil being defrosted, hence requiring the use of the by-pass lines.

It will be noted at this point that everything that has been so far described and illustrated, with the exception of the connection of the defrost header 50 to the top of receiver 30, and the pressure differential control means 48, is disclosed in U.S. Pat. No. 3,905,202 and is recognized as part of the prior art. Further, connection of a defrost header to the top of a surge-type receiver, in and of itself, is disclosed in U.S. Pat. No. 3,427,819 and does not per se constitute part of the present invention. The pressure differential control means 48 is also known, per se, being disclosed in U.S. Pat. No. 3,427,819.

The present invention is directed to an improved defrosting control for refrigeration systems of the type described previously herein, and relates to defrosting arrangements of the type primarily relying upon cool gas for defrost purposes.

In accordance with the present invention, control valve means generally designated 100 in the form of the invention shown in FIG. 1, is mounted in the connecting line 24 extending between the refrigerant liquid supply conduit 22 and the bottom of the receiver 30. In the form of the invention shown in FIG. 1, valve 100 is a solenoid valve, mounted in parallel with a check valve 103 mounted in by-pass 104 to permit flow past valve 100 in a direction from the receiver to the conduit 22 whenever the valve is closed. Valve 100 is normally open to permit flow in either direction within line 24 when normal operating conditions exist, that is, when the pressures in receiver 30 and line 22 are in a predetermined balanced state.

Extending from a source of electrical power are leads 106, 108 respectively connected to the terminals of the solenoid valve 100. Electrical power from said source is normally prevented from flowing through the normally open and deenergized valve, by reason of a differential pressure control switch 110, which is normally open and which may be mounted, as illustrated, in lead 106. Switch 110 is, per se, conventional. It may, for example, be of the diaphragm type, wherein a diaphragm deflects under predetermined, adjusted differences in pressure at opposite sides of the switch, to actuate a bridging element 112 into a contact closing position, thus to close the switch and permit flow of the electrical current to the solenoid valve 100.

The opposite, pressure-responsive sides of the switch are connected by tubular elements 114, 116 to the defrost header 50 and refrigerant liquid supply conduit 22 respectively. Element 114 is connected to header 50 between the receiver 30 and the connection of the header 50 to the defrost branch lines 79, 80. The tubular element 116 is connected to the conduit 22 at a location downstream from condenser 20, valve 26, and a check valve 102, and upstream from the connection 23 that connects conduit 22 in communication with the receiver connecting line 24.

In accordance with the invention, whenever the pressure in conduit 22 exceeds the pressure within the receiver 30 by a predetermined amount, switch 110 reacts, causing valve 100 to close. This prevents the flow of the refrigerant liquid from conduit 22 upwardly through connecting line 24 into the receiver 30.

Normally, the pressure in line 22 is similar to the receiver pressure. Any increase in pressure in line 22 above that in the receiver would result from elevation or lowering of ambient temperature surrounding the condenser, resulting from cycling of the condenser fan between on and off conditions thereof.

Normally, thus, 205 p.s.i.g. would be normal in a typical installation, in line 22 and within the receiver.

An increase in the pressure in line 22, relative to the pressure in the receiver, results in flow, under normal conditions, through connecting line 24 upwardly into the receiver. In some instances, this causes the receiver to collect refrigerant to such an extent as produces starving of the liquid supply line extending to the evaporators for the purpose of supplying refrigerant thereto for use in the refrigerating cycles of the evaporators. The receiver, at times, may fill completely with the liquid refrigerant, in these circumstances.

Check valve 102 is provided, because whenever pressure upstream from the check valve is lower than in the receiver, a reverse flow can occur, within conduit 22, through the inlet pressure regulating valve 26, which controls the compressor head pressure, as a result of which damage may result, and liquid needed for refrigeration may be temporarily lost to the condenser.

The arrangement has been found to be highly beneficial in cool gas defrosting systems, and incorporates an automatic defrost fluid switching function in a defrost system of this type.

This results from the fact that during use of saturated gaseous refrigerant, that is, "cool gas", taken from receiver 30 above the liquid level in the receiver for defrost purposes, the liquid within the receiver tends to evaporate for the purpose of providing the cool gas. Should the liquid become fully evaporated, and with the receiver pressure held in the manner described to a value less than that in line 22, hot gas will begin to flow from compressor discharge header 17, through line 52 to the receiver. The hot gas will flow through the receiver which becomes under these circumstances no more than a conduit for the hot gas, said hot gas flowing out of the receiver into the defrost header 50 and thence to the particular evaporator or evaporators that are undergoing a defrost cycle.

In this way, there is automatic switching from cool to hot gas for defrost purposes, responsive to depletion of the supply of cool gas within the receiver.

This avoids difficulties noted in the prior art, wherein in the circumstances there would be flow into the receiver from liquid line 22 to replace the evaporated liquid, thus in effect stealing liquid from the liquid supply line 22 as a result of which the possibility of flash gas is raised, together with starving of the evaporators during their refrigerating cycles.

The invention, thus, provides a carefully regulated control of the pressure within line 22 relative to the pressure within receiver 30, operable automatically whenever the pressure in the line 22 exceeds that of the receiver by a predetermined value, and adapted in these circumstances to stop what would be the normal result of such pressure differential, that is, flow from conduit 22 of refrigerant liquid into the receiver 30. At the same time, means is provided to prevent damage to the head pressure control system and its associated tubing, plus loss of control of the liquid refrigerant, through the provision of the check valve 102 located between the head pressure control valve 26 and the connection 23 of line 22 to the receiver.

It is appropriate to note why a pressure differential may develop between line 22 and receiver 30, considering the fact that valve 100 is normally open. It is true, as previously noted, that normally these pressures are similar. However, it may be recalled that during a defrost cycle, cool gas is taken from the receiver above the liquid level for defrost purposes, as a result of which the liquid within the receiver tends to evaporate for the specific purpose of providing the cool gas needed for defrost. This removal of cool gas, and the consequent evaporation of receiver liquid, has the effect of lowering the receiver pressure. As a result, a pressure differential between the receiver and the pressure in line 22 is produced, tending to cause flow into the receiver from the liquid line 22 to replace the evaporated liquid. This in effect "steals" liquid from the line 22. This only happens in the defrost cycle, and the basic concern is that when the pressure differential is in the wrong direction, so to speak (that is, when the receiver pressure goes lower than the pressure in the line 22) it becomes important to shut the valve 100 and thus prevent the refrigerant liquid in line 22 from flowing into the receiver 30. By closing the valve 100 is these circumstances, I permit the liquid in the receiver to continue evaporating to supply cool gas for the purpose of accomplishing the defrost function without the mentioned stealing of liquid from the liquid supply line to replace that which evaporates and flows out of the receiver through line 50.

In FIG. 2, there is illustrated an arrangement identical to that shown in FIG. 1, except that instead of valve 54 in line 52, there is provided a valve **54*a*** arranged as a differential pressure regulating valve, which at the high side of the compressor means may be set to maintain a pressure of 210 p.s.i.g., and which at its other side is adapted to maintain a pressure of 205 p.s.i.g. within the receiver.

This pressure differential is merely typical, and can of course be adjusted as desired. It is mainly important to note that a predetermined difference is established, and is maintained in line 52 between the compressor discharge header and the top of the receiver.

Thus, if the condenser pressure at the discharge side of the condenser should go to 230 p.s.i.g., the pressure in the receiver would automatically be reset to 225 p.s.i.g. The receiver pressure thus follows that in line 22 upwardly or downwardly, normally, but will never go below the pressure within the liquid line 22, thus assuring proper operation of the system during the defrost cycle hereinbefore mentioned.

In FIG. 3, the switch 110 is eliminated. In these circumstances there is provided a differential pressure regulating valve **100*a*, sensitive to pressures at opposite sides thereof, that is, adapted to maintain a predetermined differential between the pressure at the side of valve 100*a* connected to line 22, and the side thereof connected to the bottom of receiver 30. The pressures would be selected to assure that at all times, the valve will remain open as long as the pressure in the line 22 does not exceed that in the receiver by a predetermined value. Once that value is reached, however, valve 100*a*** closes thus to again prevent undesired flow of refrigerant liquid upwardly into the receiver, under circumstances that would cause starving of the evaporators and improper defrost operation resulting from filling of the receiver with refrigerant liquid.

Figure 4:
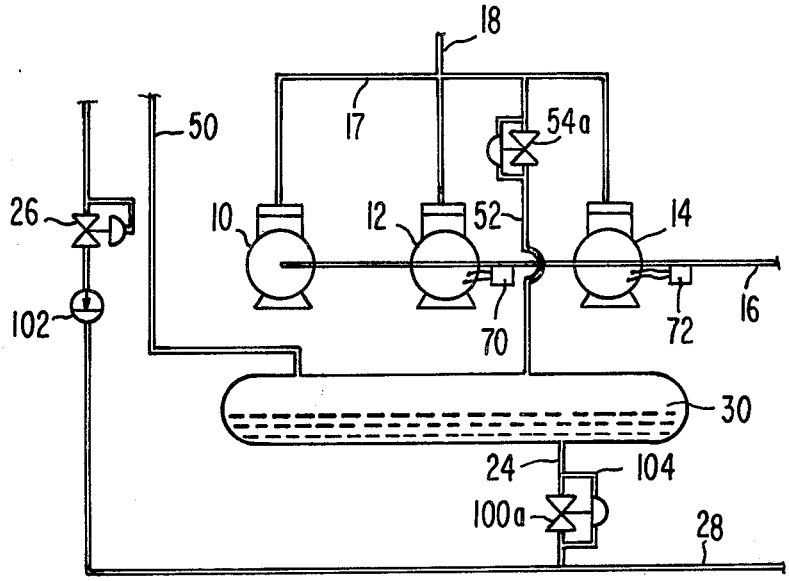
FIG. 4 is a fragmentary, diagrammatic illustration of the system showing a fourth form of the invention.

Finally, in FIG. 4 there is illustrated an arrangement similar to that shown in FIG. 3, except that an association with valve **100*a*, there is used the valve 54*a* shown in FIG. 2. This provides a regulation of the pressure in the receiver relative to that in the line 22 maintained with even more accuracy than may be possible with the construction shown in FIG. 2**.

In every form of the invention, as will be noted, there is the common characteristic wherein the pressure within the receiver relative to that in the line 22 is controlled in such fashion as to prevent flow of liquid from line 22 into the receiver whenever the line 22 pressure exceeds that in the receiver by a predetermined value. In this way, the liquid level in the receiver is accurately controlled during defrosting operation, permitting maximum utilization of the cool gas supplied from the receiver. Further, the arrangement results in the automatic switching from cool gas to hot gas for defrost purposes whenever the liquid within the receiver is fully vaporized, since there is no replenishment of the receiver liquid in these circumstances, no starving of the evaporators that may at the same time be in refrigerating cycles, and no damage to the system resulting from loss of full compressor head pressure control.

It will be understood that although valve 100 is illustrated as normally open when deenergized, the circuitry could be arranged such as to use a valve that is normally closed with the circuit open. In these circumstances, switch 110 would be closed when the receiver and liquid line pressures are in balance, to energize the valve and hold it open. When the pressures go out of balance, switch 110 would open, opening the circuit to the valve and allowing the now deenergized valve to operate to a closed position.

As used in this application, "evaporator" means either a single refrigerating coil, or a set of refrigerating coils connected for joint refrigeration or defrost thereof.

I claim:

1. In a refrigeration system including compressor means having low and high pressure sides, a plurality of evaporators each of which has one end connected to the low side of the compressor means, a refrigerant liquid supply line having an inlet end, said line having a discharge end connected to the other ends of the evaporators, condenser means having an input side connected to the high side of the compressor means and an output side connected to the inlet end of the liquid line, a surge-type receiver, a connecting line extending between the receiver and the liquid line, and a defrost line extending from the receiver to said one end of the evaporators for supplying saturated gaseous refrigerant to the evaporators for defrosting the same, the improvement that comprises defrost control means for permitting flow in both directions through said connecting line in the presence of a predetermined pressure balance as between the receiver and liquid line, and for preventing flow at least in a direction from the liquid line to the receiver, responsive to the appearance therebetween of a pressure imbalance in which the liquid line exceeds, by a predetermined differential value, the pressure within the receiver.

2. In a refrigeration system the improvement of claim 1 wherein said defrost control means includes a main flow control valve in the connecting line arranged to permmit free flow in both directions therethrough in the balanced pressure condition of the receiver and liquid line, and limiting said flow in response to the appearance of said pressure differential.

3. In a refrigeration system the improvement of claim 1 wherein said defrost control means includes a main flow control valve in the connecting line arranged to permit free flow in both directions therethrough in the balanced pressure condition of the receiver and liquid line, and limiting said flow in response to the appearance of said pressure differential, said defrost control means further including a check valve mounted in the liquid line upstream from the connecting line and arranged to prevent reverse fluid flow within the liquid line through the check valve in a direction toward the output side of the condenser means.

4. In a refrigeration system the improvement of claim 1 wherein said defrost control means includes a main flow control valve in the connecting line arranged to permit free flow in both directions therethrough in the balanced pressure condition of the receiver and liquid line, and limiting said flow in response to the appearance of said pressure differential, and a check valve connected in by-pass relation to said main flow control valve and mounted to permit free flow only in a direction from the receiver to the liquid line, in the flow-limiting condition of the main flow control valve.

5. In a refrigeration system the improvement of claim 4, said defrost control means further including a tubular means connected between, and communicating at opposite ends with, the liquid line and the defrost line respectively, a pressure-sensitive switch in the tubular means operable from a normally deactivated position responsive to the appearance of said pressure differential, and circuit means connecting the main flow control valve and said switch with a source of electric power, for actuating the main flow control valve to its flow-limiting position in response to operation of the switch from its normal position when the pressure differential between the receiver and the liquid line is sensed.

6. In a refrigeration system the improvement of claim 1 wherein said defrost control means includes a main flow control valve in the connecting line arranged to permit free flow in both directions therethrough in the balanced pressure condition of the receiver and liquid line, and limiting said flow in response to the appearance of said pressure differential, said defrost control means further including a receiver pressure control line connected between the high side of the compressor means and the receiver, and a pressure reducing valve in said last-named line effective to maintain the receiver pressure at a value that is less than that at the high side of the compressor means, and that is selected to produce flow of hot gas from said high side to and through the receiver into the defrost line in response to the depletion, within the receiver, of the supply of saturated gaseous refrigerant.

7. In a refrigeration system the improvement of claim 6 wherein said pressure reducing valve is arranged to maintain a predetermined difference in pressures between said high side of two compressor means and the receiver such that the receiver pressure follows, but does not fall below, that in this liquid line.

8. In a refrigeration system the improvement of claim 1, further including a receiver pressure control line connected between the high side of the compressor means and the receiver, and a pressure reducing valve in said control line adapted to maintain the pressure in the receiver at a value that is less than that at the high side of the compressor means and is selected to produce flow of hot gas from said high side through the receiver and into the defrost line for defrost purposes upon depletion, within the receiver, of the supply of saturated gaseous refrigerment.

9. In a refrigeration system the improvement of claim 8 in which said last-named valve comprises a differential pressure regulating valve adapted to maintain a predetermined pressure at the high side of the compressor means and in the receiver respectively, the receiver pressure being selected to be less than that at the high side by a predetermined extent and to remain less by said extent during pressure fluctuations occurring within the high side of the refrigeration system.

* * * * *

UNITED STATES PATENT AND TRADEMARK OFFICE

CERTIFICATE OF CORRECTION

PATENT NO. : 4,167,102

DATED : September 11, 1979

INVENTOR(S) : Benjamin R. Willitts

It is certified that error appears in the above-identified patent and that said Letters Patent are hereby corrected as shown below:

Column 7, line 10, change "is" to --in--.

Column 10, line 23, change "refrigerment" to --refrigerant--.

Signed and Sealed this

*Sixteenth* Day of *September 1980*

[SEAL]

*Attest:*

SIDNEY A. DIAMOND

*Attesting Officer*

*Commissioner of Patents and Trademarks*